US005212329A

United States Patent [19]

Woodworth

[11] Patent Number: 5,212,329

[45] Date of Patent: May 18, 1993

[54] ELECTRIC GUITAR MOUNTABLE UPON ACOUSTIC GUITAR

[76] Inventor: Henry F. Woodworth, 146 Walnut, Northville, Mich. 48167

[21] Appl. No.: 742,611

[22] Filed: Aug. 8, 1991

[51] Int. Cl.[5] ..... G10D 1/00; G10D 1/08; G10D 3/00

[52] U.S. Cl. ..... 84/263; 84/267; 84/327

[58] Field of Search ..... 84/263, 267, 290, 291, 84/327, 453

[56] References Cited

U.S. PATENT DOCUMENTS 1,828,315 10/1931 Cavicchioli ..... 84/291
2,222,959 11/1940 Stathopoulo .
3,636,809 1/1972 Ezaki .
4,343,217 8/1982 Brody .
4,785,705 11/1988 Patterson ..... 84/327
4,987,815 1/1991 Shockley ..... 84/291

*Primary Examiner*—Michael L. Gellner
*Assistant Examiner*—Cassandra Spyrou
*Attorney, Agent, or Firm*—Brooks & Kushman

[57] ABSTRACT

An electric guitar (10) is disclosed as including spacers (50,52,54) and connector straps (56,58) that cooperate to provide mounting of the electric guitar on an acoustic guitar (12) in a spaced and fixed relationship. Three of the spacers are preferably utilized with one being an adjustable spacer (50) and two being end spacers (52,54) between which the adjustable spacer (50) is located in a central and rearwardly spaced position that also accommodates for adjustment of the guitar faces with respect to each other. In one embodiment, the connector straps (56,58) have a resilient construction and in another embodiment incorporate adjustable clamps (84,86).

16 Claims, 1 Drawing Sheet

ELECTRIC GUITAR MOUNTABLE UPON ACOUSTIC GUITAR

TECHNICAL FIELD

This invention relates to an electric guitar that is mountable upon an acoustic guitar and also relates to a mounting kit for adapting a preexisting electric guitar for such mounting on an acoustic guitar.

BACKGROUND ART

Playing of guitar music often requires switching from one guitar to another which has been accomplished in the past by multiple neck instruments such as disclosed by U.S. Pat. Nos. 2,222,959 Stathopoulo which involves an electric guitar having a pair of necks that extend parallel to each other and face in the same direction; 3,636,309 Ezaki which involves an acoustic guitar having a pair of necks that extend parallel to each other and face in opposite directions; and 4,343,217 Brody which involves an electric guitar having a pair of necks that extend parallel to each other and extend in opposite directions from a body that is pivotally mounted so as to permit convenience in switching from one neck to the other. Also, U.S. Pat. No. 4,785,705 Patterson discloses flexible connectors for hanging one electrical guitar from another. None of these prior types of guitars has found widespread acceptance by guitar players who often still use a stand for holding an electric or acoustic guitar and will wear only the other guitar while playing short compositions on the guitar held by the stand.

SUMMARY OF INVENTION

An object of the present invention is to provide an improved electric guitar that is capable of being fixedly mounted on an acoustic guitar so both guitars can be conveniently played.

In carrying out the above object, the electric guitar includes a body and a neck that extends from the body and has a head. The body has a face including a tailpiece for connecting wires, and the head has means, such as tuning pegs, for connecting the wires which are tensioned so the guitar can be played. The body has an electrical sound producer for use in producing an electrically transmitted sound as tensioned wires are strummed between the head and the tailpiece. The body in addition has a vertical edge for opposing a vertical side of a sound box of an acoustic guitar. Spacers space the vertical edge of the electric guitar from the vertical side of the sound box of the acoustic guitar, and connector means are also provided for securing the electric guitar to the acoustic guitar in a fixed and spaced relationship with respect to each other in cooperation with the spacers.

Mounting of the electric guitar on the acoustic guitar allows the guitar player to easily switch from one guitar to the other during a riff without the time interruption which necessarily takes place if the guitar player must remove one guitar and put the other one on by placing the neck strap over the head. Likewise, the fixed relationship of the electric guitar with respect to the acoustic guitar allows both guitars to be played without one guitar flapping with respect to the other as would take place if the guitar were merely hung by flexible connectors.

In the preferred construction, the vertical edge of the electric guitar body is a lower edge and opposes an upper side of the sound body of the acoustic guitar on which the electric guitar is mounted. Since the electric guitar has a much smaller body than the acoustic guitar, it is easier to play both guitars in this relationship with the electric guitar mounted above the acoustic guitar. Furthermore, the vertical edge of the electric guitar body is preferably contoured so as to be generally complimentary to the shape of acoustic guitars and thereby reduces the size of the spacing between the electric guitar and the acoustic guitar on which it is mounted. Most preferably, the vertical edge of the electric guitar body is a lower contoured edge that opposes an upper contoured side of the sound box of the acoustic guitar on which the electric guitar is mounted in a generally complementary relationship that also positions the electric guitar above the acoustic guitar to facilitate playing of both guitars due to the smaller size of the electric guitar body.

In the preferred construction, three spacers are utilized to space the electric guitar from the acoustic guitar. At least one of the spacers is preferably an adjustable spacer so as to accommodate for different spaced relationships between the electric guitar and the acoustic guitar. The adjustable spacer preferably includes threaded components that are threaded with respect to each other to provide the adjustment. Most preferably, there are three spacers that space the electric guitar from the acoustic guitar with two of the spacers being end spacers respectively located adjacent the opposite ends of the body and with one of the spacers being an adjustable central spacer located between the two end spacers and being adjustable to control the orientation of the electric guitar with respect to the acoustic guitar. The adjustable central spacer is most preferably located rearwardly from the two end spacers with respect to the face of the body. The adjustable central spacer includes threaded components that are threaded with respect to each other to provide the adjustment.

Different constructions can be provided to function as the connector means that fixedly secures the electric guitar to the associated acoustic guitar in cooperation with the spacers. In one construction, a pair of resilient straps provide the connector means that extend in a tensioned manner between the electric guitar and the acoustic guitar to provide the fixed relationship therebetween in cooperation with the spacers. In another construction, a pair of connector straps extend between the electric guitar and the acoustic guitar and at least one cf the connector straps, and most preferably both connector straps, has an associated adjustable clamp for providing tensioning thereof such that the pair of connector straps cooperate with each other and with the spacers in providing the fixed relationship of the electric guitar on the acoustic guitar.

Another object of the present invention is to provide a mounting kit for mounting an electric guitar on an acoustic guitar. This mounting kit can be adapted for use with any electric guitar including a body and a neck that extends from the body and has a head, wherein the body has a tailpiece for connecting wires and the head has means, such as tuning pegs, for connecting the wires which are tensioned so the guitar can be played, wherein the body also has an electrical sound producer for use in producing an electrically transmitted sound as tensioned wires are strummed between the head and the tailpiece, and wherein the body has a vertical edge for opposing a vertical side of a sound box of an acoustic guitar. The mounting kit utilized with such an electric guitar includes spacers for mounting &he vertical edge of the electrical guitar and the vertical side of the sound box of the acoustic guitar to provide a spaced relationship between these guitars. (connectors secure the electric guitar to the acoustic guitar in a fixed and spaced relationship with respect to each other in cooperation with the spacers so as to thereby adapt the electric guitar for mounting on the acoustic guitar.

The objects, features and advantages of the present invention are readily apparent from the following detailed description of the best modes for carrying out the invention when taken in connection with the accompanying drawings.

DETAILED DESCRIPTION OF THE INVENTION

Figure 1:
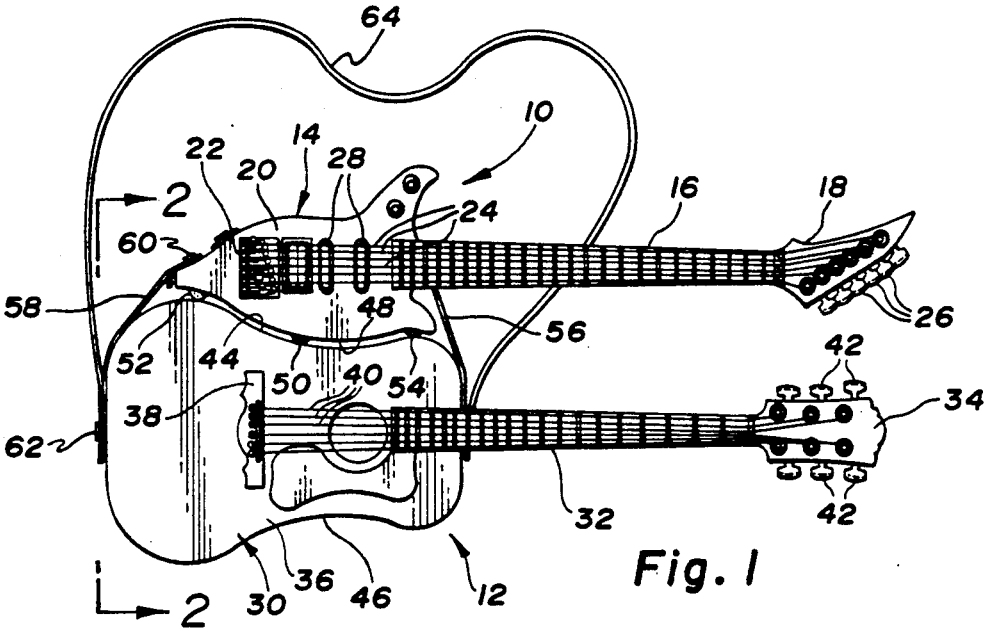
FIG. 1 is a front view illustrating an electric guitar that is mounted on an acoustic guitar in accordance with the present invention.

With reference to FIG. 1 of the drawings, an electric guitar constructed in accordance with the present invention is generally indicated by 10 and is constructed as is hereinafter more fully described so as to be mountable in a fixed relationship upon an acoustic guitar indicated by 12. This electric guitar 10 includes a body 14 and a neck 16 that extends from the body and has a distal head 18. Body 14 has a face 20 including a tailpiece 22 for connecting adjacent ends of wires or strings 24. Head 18 has tuning pegs 26 for connecting the other ends of the wires or strings 24 and providing adjustable tensioning thereof to tune the guitar. Body 14 of the electric guitar 10 also has an electrical sound producer 28 which may be a pickup, microphone, transducer, etc. Furthermore, it should be appreciated that this electric guitar may be either of the conventional type or synthesizer type since either one is desirably utilized with an acoustic guitar to provide rapid transition between playing of one guitar and the other.

With continuing reference to FIG. 1, the acoustic guitar 12 with which the electric guitar 10 is utilized is of a conventional type including a sound box 30 from which a neck 32 extends to a distal head 34. A face 36 of the sound box 30 has a tailpiece 38 that connects adjacent ends of wires or strings 40 whose other ends are adjustably tensioned by tuning pegs 42 of head 34. Sound box 30 also has upper and lower vertical sides 44 and 46 which have concave shapes between the opposite ends of the sound box in a conventional manner. It should also be noted that the tuning pegs can be located at the tailpiece on the face of the sound box.

Figure 3:
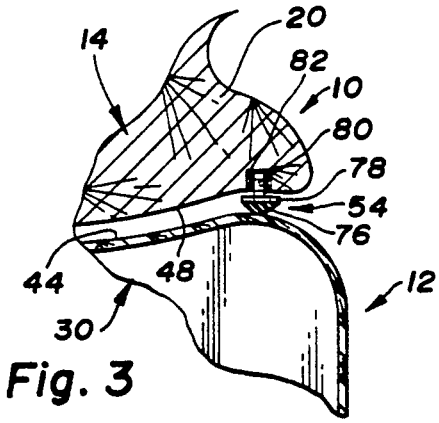
FIG. 3 is a partial sectional view illustrating one spacer that spaces the electric guitar from the acoustic guitar.

As shown in both FIGS. 1 and 3, the electric guitar 10 has a vertical edge 48 that opposes a vertical side of the sound box 30 of acoustic guitar 12. Spacers 50, 52 and 54 space the vertical edge 48 of the electrical guitar from the vertical side of the acoustic guitar so as not to destroy the quality of the sound generated by the sound box of the acoustic guitar i.e. to prevent sound transmission between the guitars. These spacers 50, 52 and 54 are also spaced from each other to preserve the acoustic sound quality as is hereinafter more fully described. A pair of straps 56 and 58 provide a connector means for securing the electric guitar 10 to the acoustic guitar 12 in a fixed and spaced relationship with respect to each other in cooperation with the spacers 50, 52 and 54. Each connector strap 56 and 58 has opposite ends secured by suitable connectors 60 and 62 to the electric guitar 10 and the acoustic guitar 12, respectively.

A musician can thus play the electric and acoustic guitars 10 and 12 by placing the support strap 64 around the neck so that both guitars can be easily played with a quick transition from one to the other without substantial loss in timing and musical effect during the transition.

In the preferred construction of the electric guitar 10 illustrated in FIG. 1, the vertical edge 48 of the body 20 is a lower edge and opposes the upper side 44 of the sound box 30 of acoustic guitar 12 on which the electric guitar is mounted. Thus, the electric guitar 10 is located above the acoustic guitar 12 in the preferred construction. Since the electric guitar body 20 is smaller than the acoustic guitar sound box 30, this construction allows both guitars &:o be more easily played than would be possible if the electric guitar were located below the acoustic guitar. Furthermore, the vertical edge 48 of the electrical guitar body 20 is preferably contoured so as to be generally complementary to the shape of acoustic guitars such that the electric and acoustic guitars interfit with each other as shown to reduce the vertical space between the wires or strings of the two guitars in order to facilitate playing of both guitars. Thus, the vertical lower edge 48 of the electric guitar body 20 has a contoured shape that opposes the vertical upper contoured side 44 of the sound box 30 of acoustic guitar 12 on which the electric guitar is mounted in a generally complementary relationship in association with the spacers and connector straps as previously described.

Figure 4:
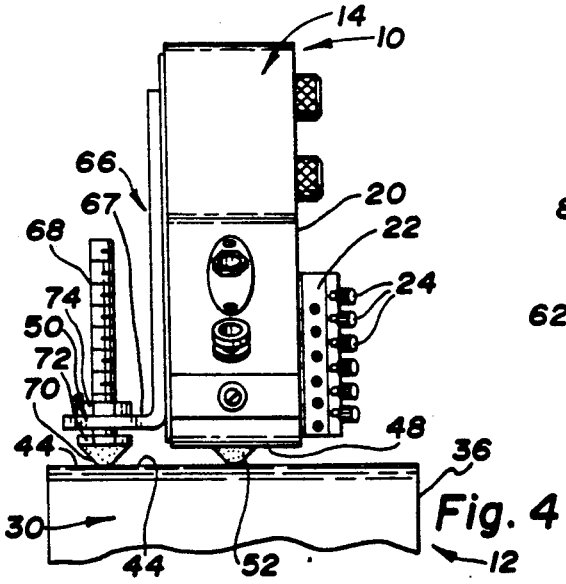
FIG. 4 is an enlarged view taken in the same direction as FIG. 3 to further illustrate the manner in which the spacers locate the electric guitar in a spaced relationship from the acoustic guitar.

As illustrated in FIG. 1 and previously described, the electric guitar 10 includes three spacers 50, 52 and 54 that space the electric guitar from the acoustic guitar. One of the spacers 50 best illustrated in FIG. 4 is an adjustable spacer whose adjustment provides for different mounting configurations and also permits adjustment of the orientation of the faces of the two guitars with respect to each other. More specifically, the adjustable spacer 50 includes an L-shaped bracket 66 whose longer leg is fixedly secured in a suitable manner to the rear surface of the guitar body 20 and whose shorter leg 67 has a threaded opening that receives a threaded shaft 68 of the spacer 50. The lower end of the threaded shaft 68 supports a somewhat pointed resilient pad 70 and also supports a hexagonal nut 72 just above the pad. Rotational adjustment of the hexagonal nut 72 moves the shaft 68 vertically with respect to the rearwardly projecting leg 67 of the bracket and thereby moves the resilient pad 70 for appropriate adjustment. After such adjustment, another nut 74 of the adjustable spacer is torqued against the bracket leg 67 to secure the adjusted position.

As best illustrated in FIG. 1, two of the spacers 52 and 54 are end spacers respectively located adjacent opposite ends of the electric guitar body 20. Each of these two end spacers has the same construction as the one end spacer 54 illustrated in FIG. 3 with a somewhat pointed resilient pad 76 supported by a hexagonal nut 78 from which a threaded shaft 80 extends upwardly into a threaded insert 82 in the electric guitar body 20. Between the two end spacers 52 and 54, the one adjustable spacer 50 is located at a central location and, most preferably, at a rearward location with respect to the end spacers as shown in FIG. 4 so as to permit angular adjustment of the two guitar faces with respect to each other upon upward and downward threading of the shaft 68 of the adjustable spacer. Thus, the adjustable spacer 50 not only accommodates for different acoustic guitar configurations but also provides for different angular orientations of the guitar faces with respect to each other.

Figure 2:
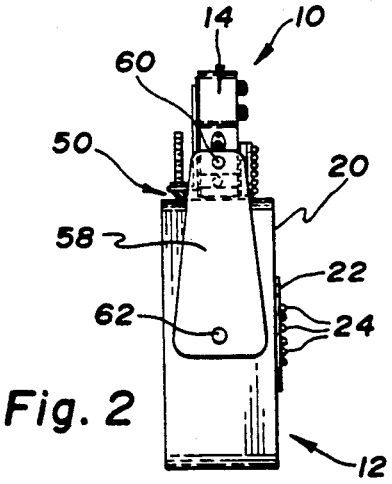
FIG. 2 is an end view taken along the direction of line 2—2 in FIG. 1 to further illustrate the manner in which the electric guitar is mounted on the acoustic guitar.

In the construction illustrated in FIGS. 1 and 2, each of the connector straps 56 and 58 has a resilient construction and is slightly tensioned extending between the associated connectors 60 and 62 on the electric and acoustic guitars 10 and 12, respectively, so as to thereby provide the fixed relationship between the two guitars in cooperation with the spacers described above.

Figure 5:
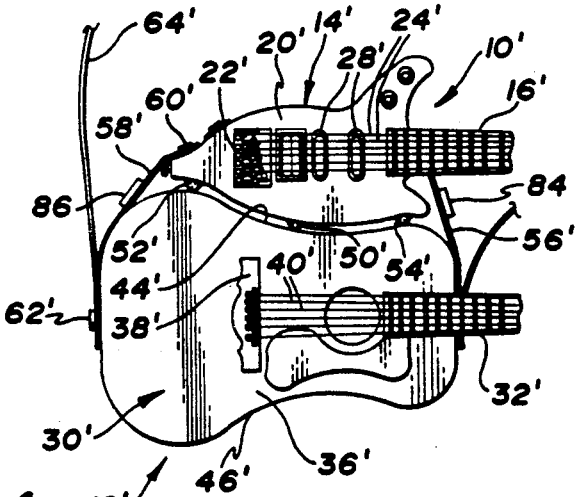
FIG. 5 illustrates an alternate construction of connectors that connect the electric guitar to the acoustic guitar in a fixed relationship in cooperation with the spacers.

With reference to FIG. 5, another embodiment of the electric guitar has the same construction as the previously described embodiment except as will be noted such that its like components are identified like primed reference numerals and much of the previous description is applicable so as not to require repetition. This embodiment of the electric guitar 10' has flexible connector straps 56 and 58 that ex&end between the electric and acoustic guitars at suitable connectors 60 and 62, respectively, but with at least one and preferably both of the straps having an associated adjustable clamp 84 or 86 that provides adjustable tensioning of the associated strap.

While the invention has been described in connection with an electric guitar already adapted for the mounting on the acoustic guitar, it should be appreciated that it is also possible to utilize a kit for adapting preexisting electric guitars for mounting on acoustic guitars. Such a kit will require the spacers as previously described for mounting between the vertical edge of the electric guitar and the vertical side of the sound box of the acoustic guitar to provide a spaced relationship between the two guitars and will also require the connectors for securing the electric guitar to the acoustic guitar in a fixed and spaced relationship with respect to each other in cooperation with the spacers.

While the best modes for carrying out the invention have been described in detail, those familiar with the art to which this invention relates will recognize various alternative designs and embodiments for practicing the invention as defined by the following claims.

What is claimed is:

1. An electric guitar comprising: a body and a neck that extends from the body and has a head; said body having a face including a tailpiece for connecting wires; said head having means for connecting the wires which are tensioned so the guitar can be played; said body having an electrical sound producer for use in producing an electrically transmitted sound as the tensioned wires are strummed between the head and the tailpiece; said body having a vertical edge for opposing a vertical side of a sound box of an acoustic guitar; spacer means for spacing said vertical edge of the electric guitar from said vertical side of the acoustic guitar to prevent sound transmission between the guitars; and connector means for securing the electric guitar to the acoustic guitar in a fixed and spaced relationship with respect to each other in cooperation with the spacer means.

2. An electric guitar as in claim 1 wherein said vertical edge of the body is a lower edge and opposes an upper contoured side of the sound box of the acoustic guitar on which the electric guitar is mounted.

3. An electric guitar as in claim 1 wherein said vertical edge of the body is contoured so as to be generally complementary to a shape of the sound box of the acoustic guitar.

4. An electric guitar as in claim 1 wherein said vertical edge of the body has a lower contoured edge and opposes an upper contoured side of the sound box of the acoustic guitar on which the electric guitar is mounted in a generally complementary relationship.

5. An electric guitar as in claim 1 wherein said spacer means includes three spacers that space the electric guitar from the acoustic guitar.

6. An electric guitar as in claim 1 wherein said spacer means includes an adjustable spacer.

7. An electric guitar as in claim 6 wherein the adjustable spacer includes threaded components that are threaded with respect to each other to provide the adjustment.

8. An electric guitar as in claim 1 wherein said spacer means includes three spacers that space the electric guitar from the acoustic guitar, two of the spacers being end spacers respectively located adjacent opposite ends of the body, and one of the spacers being an adjustable central spacer located between the two end spacers and being adjustable to orient the electric guitar with respect to the acoustic guitar.

9. An electric guitar as in claim 8 wherein the adjustable central spacer is located rearwardly from the two end spacers with respect to the face of the body.

10. An electric guitar as in claim 9 wherein the adjustable central spacer includes threaded components that are threaded with respect to each other to provide the adjustment.

11. An electric guitar as in claim 1 wherein the connector means comprises a pair of resilient straps that extend between the electric guitar and the acoustic guitar in a tensioned manner to provide the fixed relationship therebetween in cooperation with the spacers.

12. An electric guitar as in claim 1 wherein the connector means comprises a pair of connector straps that extend between the electric guitar and the acoustic guitar, and at least one of the connector straps having an adjustable clamp for providing tensioning thereof such that the pair of connector straps cooperate with each other and with the spacers in providing the fixed relationship of the electric guitar on the acoustic guitar.

13. An electric guitar as in claim 12 wherein each of said connector straps has an associated adjustable clamp.

14. An electric guitar comprising: a body and a neck that extend from the body and has a head; said body having a face including a tailpiece for connecting wires; said head having means for connecting the wires which are tensioned so the guitar can be played; said body having an electrical sound producer for used in producing an electrically transmitted sound as tensioned wires are strummed between the head and tailpiece; said body having a contoured lower edge for opposing an upper contoured side of a sound box of an acoustic guitar in a complementary relationship; spacer means for spacing said contoured lower edge of the electric guitar form the upper side of the sound box of the acoustic guitar to prevent sound transmission between the guitars; and connectors for securing the electric guitar to the acoustic guitar in a fixed and spaced relationship with respect to each other in cooperation with the spacer means.

15. An electric guitar comprising: a body and a neck that extend from the body and has a head; said body having a face including a tailpiece for connecting wires; said head having means for connecting the wires which ar tensioned so the guitar can be played; said body having an electrical sound producer for use in producing an electrically transmitted sound as tensioned wires are strummed between the head and tailpiece; said body having a lower contoured edge for opposing an upper contoured side of a sound box of an acoustic guitar in a complementary relationship; spacer means for spacing said contoured lower edge of the electric guitar form the upper side of the sound box of the acoustic guitar to prevent sound transmission between the guitars; said spacer means including two end spacers respectively located adjacent opposite ends of the body and said spacer means also including an adjustable central spacer located between the tow end spacers rearwardly thereof with respect to the face and being adjustable to control the spacing of the electric guitar form the acoustic guitar; and connectors for securing the electric guitar to the acoustic guitar in a fixed and spaced relationship with respect to each other in cooperation with the spacers of the spacer means.

16. A mounting kit for use with an electric guitar including a body and a neck that extends from the body and has a head, wherein said body has a tailpiece for connecting wires and said head has means for connecting the wires which are tensioned so that guitar can be played, wherein said body has an electrical sound producer for use in producing an electrically transmitted sound as tensioned wires are strummed between the head and the tailpiece, ad wherein said body has a vertical edge for opposing a vertical side of a sound box of an acoustic guitar, the mounting kit comprising: space means for mounting on the electric guitar between the vertical edge of the electric guitar and the vertical side of the sound box of the acoustic guitar to provide a spaced relationship therebetween to prevent sound transmission between the guitars; and connectors for securing the electric guitar to the acoustic guitar in a fixed and spaced relationship with respect to each other in cooperation with the spacer means.

* * * * *

UNITED STATES PATENT AND TRADEMARK OFFICE

CERTIFICATE OF CORRECTION

PATENT NO. : 5,212,329

DATED : May 18, 1993

INVENTOR(S) : Henry F. Woodworth

It is certified that error appears in the above-identified patent and that said Letters Patent is hereby corrected as shown below:

Column 3, line 1, "&he"
should be --the--;

Column 3, Line 4
"(connectors" should be --Connectors--;

Column 4, Line 30
"&:o" should be --to--;

Column 5, Line 32,
"ex&end" should be --extend--;

Column 6, Line 59, Claim 14 , "extend"

should be --extends--;

Column 6, Line 63, Claim 14 , "used"

should be --use--;

Column 7, Line 1, Claim 14, "form"

should be --from--;

Column 7, Line 8, Claim 15 "extend"

should be --extends--;

UNITED STATES PATENT AND TRADEMARK OFFICE

CERTIFICATE OF CORRECTION

PATENT NO. : 5,212,329

DATED : May 18, 1993

INVENTOR(S) : Henry F. Woodworth

It is certified that error appears in the above-indentified patent and that said Letters Patent is hereby corrected as shown below:

Column 8, Line 1, Claim 15 "form"

should be --from--;

Signed and Sealed this

Twelfth Day of April, 1994

Bruce Lehman

*Attest:*

BRUCE LEHMAN

*Commissioner of Patents and Trademarks*

*Attesting Officer*